United States Patent [19]

Harkness

[11] Patent Number: 4,651,125

[45] Date of Patent: Mar. 17, 1987

[54] RESISTOR GRID ASSEMBLY WITH RIB TURBULENCE GENERATORS

[75] Inventor: Jack A. Harkness, Lafayette, Ind.

[73] Assignee: Dynamic Corporation, Montmorenci, Ind.

[21] Appl. No.: 886,990

[22] Filed: Jul. 17, 1986

Related U.S. Application Data

[63] Continuation-in-part of Ser. No. 737,253, May 23, 1985.

[51] Int. Cl.[4] ..... H01C 7/22

[52] U.S. Cl. ..... 338/295; 338/315; 338/319; 338/58

[58] Field of Search ..... 338/58, 279, 280, 284, 338/287, 295, 315, 318-320

[56] References Cited

U.S. PATENT DOCUMENTS

| | | | |
|---|---|---|---|
| 2,721,920 | 10/1955 | Weide | 338/293 |
| 2,772,337 | 11/1956 | Du Bois | 338/217 |
| 2,858,402 | 10/1958 | Griffes et al. | 338/58 |
| 2,874,257 | 2/1959 | Kuhn et al. | 338/58 |
| 2,969,516 | 1/1961 | Du Bois | 338/284 |
| 3,212,045 | 10/1965 | Weyenberg | 338/284 X |
| 3,543,213 | 11/1970 | Weyenberg | 338/290 |
| 4,100,526 | 7/1978 | Kirilloff et al. | 338/295 X |
| 4,146,868 | 3/1979 | Kirilloff et al. | 338/315 X |
| 4,359,710 | 11/1982 | Luy | 338/280 X |

*Primary Examiner*—C. L. Albritton

*Attorney, Agent, or Firm*—Woodard, Weikart, Emhardt & Naughton

[57] ABSTRACT

A grid assembly for converting electrical energy to heat and then dissipating same. A plurality of parallel grid members include outwardly extending legs received in holes provided on mutually facing surfaces on polyester glass insulator members. The grid members are arranged in a continuous serpentine path from an input to an output terminal. The grid members are of sheet metal construction with the cylindrical legs formed by a radiused sheet metal configured leg portion of one grid member positioned adjacent an identical configured and mutually opposed leg portion of an adjacent grid member. The main body of each grid member extends from the legs through a flat portion and then through a diverging end portion spacing the main bodies of the grid members apart. In an alternate embodiment, the grid members are arranged with different lengths to provide a particular sized and configured grid assembly. Each grid member includes a plurality of strengthening ribs which extend outwardly therefrom creating air turbulence and increasing heat transfer from the grid member to the surrounding air.

20 Claims, 8 Drawing Figures

RESISTOR GRID ASSEMBLY WITH RIB TURBULENCE GENERATORS

CROSS REFERENCE TO RELATED APPLICATION

This application is a continuation-in-part of my allowed co-pending application Ser. No. 737,253 filed May 23, 1985 and entitled Resistor Grid Assembly.

BACKGROUND OF THE INVENTION

1. Field of the Invention

This invention is in the field of heat dissipating devices for use with electric motors.

2. Description of the Prior Art

The present invention relates in general to resistor units for the dynamic braking of large electric motors such as those used to power locomotives and specifically to a resistor grid design which reduces the heat transferred from the resistance material to the insulator mounting material.

During the braking of electric motors, the coasting motor continues to generate a large amount of excess electrical energy that must be dissipated. It has been customary in the art to divert such excess energy into banks of resistor grids. Such resistor grids have typically been arranged in the form of a plurality of parallel metal grids, with the grids being affixed to and positioned between a pair of insulator members. During braking, the high current values shunted into the resistor grids elevate grid temperatures to such a point that melting occurs unless the grids can be effectively cooled. Thus, it is known that it is necessary to preserve uniform air spaces between the parallel grids so that heat produced in the grids may be readily dissipated by convection to the surrounding air. Typically, a blower is used to aid the heat convection process. Furthermore, the stresses due to repeated expansion and contraction of the heated resistance grid members each time braking occurs must be taken into account to avoid failure of the grid members. Unless the heat expansion of the grids takes place in a controlled manner, the grids may warp out of their parallel alignment, thus resulting in a non-uniform cooling air flow and consequent unit failure.

In attempting to solve the aforementioned problems, various resistor grid structures have been deviced as shown in U.S. Pats. Nos. 2,721,920 to Weide; 2,772,337 to DuBois; 2,858,402 to Griffes et al; 2,874,257 to Kuhn et al, and 3,543,213 to Weyenberg. Such grid structures have proven to be overly complex, therefore requiring expensive manufacturing and assembly procedures. For example, U.S. Pat. No. 2,721,920 issued to Weide teaches the use of a continuous one-piece formed grid supported between insulator members by means of brackets. Costly manufacturing equipment is required to fabricate such a one-piece grid and, once formed, such a grid is highly subject to damage during the assembly process. Further, the forming machines for such a one-piece grid structure are capable of making grids of but a single width and gauge thickness thus reducing unit component flexibility. The continuous grid structure also has the disadvantage of expanding in both vertical and horizontal directions upon heating. If the horizontal expansion is not precisely uniform throughout the structure, a warping of the parallel grids is caused thus reducing cooling air flow to the grid sections resulting in heat damage to the grids and consequent unit failure. U.S. Pat. No. 2,772,337 teaches the welding of resistance grids to circular pins which are then inserted into insulator members. The welding of planar grids to each side of a circular pin has proven to be costly and time consuming from a manufacturing aspect and, further, renders the structure susceptible to vibrational failures in a locomotive environment. U.S. Pat. No. 2,858,402 requires spreader plates along the length of the grid assemblies to prevent heat expansion warping of the parallel grids. In addition, the latter patent discloses welded grid portions extending entirely through open slots in the insulator members requiring costly means for mounting the insulator members to the outer casing. U.S. Pat. No. 2,874,257 uses a continuous one-piece grid structure and thus encounters problems similar to those of the Weide patent. U.S. Pat. No. 3,543,213 teaches the use of separate insulator blocks at each weld joint of a series of U-shaped grids strips. The grid strips extend through the separate insulator blocks and the construction is such that the grid strips must bend upon heat expansion. Thus, a complex assembly is required using a multiple insulator block construction. Unless the grid heat expansion bending is precisely uniform, a disadvantageous distribution of cooling air will result.

In U.S. patent application Ser. No. 892,887 filed Apr. 3, 1978, now abandoned, I suggested positioning welded grid panels between two slotted insulator members with a clearance between the grids and one insulator member to allow heat expansion of the grids solely in a one direction during operation. This structure addressed the resistor cooling and expansion problems, as well as the complexity and expense problems associated with the other improvements developed in the art.

Recent governmental restrictions on the use of asbestos as an insulating material have created a need for a resistor grid design which will allow the use of lower temperature insulating materials. The heat from the current carrying resistor grid is transferred to the insulator by conduction, due to the method of mounting the grid to the insulator. Heat transfer by radiation and convection also occurs due to the proximity of the current carrying portion of the resistor grid to the insulator and the fact that forced air is used to aid in transferring heat away from the grid.

Improvements in resistor grid structures have helped solve problems associated with grid warping and cooling, and have made the manufacturing of grid structures easier and less expensive. The invention disclosed in my aforementioned co-pending application is addressed to continuing to solve the aforementioned problems, and further allowing for the use of lower temperature insulating materials in resistor grid structures.

Additional prior art cited during the prosecution of my aforementioned co-pending patent application includes the following U.S. Pats. Nos. 2,812,410 and 2,969,516 issued to Du Bois, 3,212,045 issued to Weyenberg, 4,100,526 and 4,146,868 issued to Kirilloff et al, and 4,359,710 issued to Luy.

I have previously disclosed and claimed in my aforementioned co-pending application a resistor grid assembly with strengthening ribs which extend substantially across the length of the grid segments. I have also discovered and disclose herein an improved resistor grid assembly which exhibits greater heat transfer between the grid segments and the surrounding air. The grid segments have specially configured and arranged ribs to create turbulence of the air passing over the segments thereby increasing the heat transfer from the segment to the surrounding air.

SUMMARY OF THE INVENTION

One embodiment of the present invention is a resistor grid comprising a plurality of first planar grid members of resistance material, each of the grid members having first and second offset planar ends, the ends of adjacent grid members being welded together to form a tight first serpentine path for the flow of electric current, the grid members positioned outermost in the serpentine path having first terminal means connected thereto to provide electrical current input and discharge paths for the resistor grid, the ends of the grid members welded together across their widths and each having a first leg extending only partially across said widths and projecting outwardly therefrom in a direction generally parallel to the longitudinal axis of the grid members with said grid members including said leg being of a one piece sheet metal construction, and first and second insulator members each having a plurality of leg-receiving holes located on one side thereof, the insulating members being spaced apart with the one side of the members being inwardly opposed to one another, the leg of the members being positioned in the leg-receiving holes of the first and second insulator members, the grid members each have thickness with the grid members including turbulence producing ribs formed thereon extending lengthwise thereon and an outward distance, the ribs strengthening the members and including an outwardly located portion creating air turbulence increasing heat transfer between the grid members and surrounding air.

Another embodiment of the present invention is a resistor grid assembly comprising a pair of mounting members of electrical non-conductive material having mutually opposed faces each with rows of generally round spaced apart holes formed therein, a plurality of individual electrically-conductive heat transfer strips with mutually opposed faces, each strip having a sheet metal main body with a first end portion and a second end portion offset equal distances but on opposite sides therefrom and being integrally connected to the main body, the strips are arranged in alternating fashion to position each first end portion into first pairs and each second end portion into second pairs offset from the first pairs, the first pairs and the second pairs each have width equal to the main body with the first pairs welded together and the second pairs welded together across the width arranging the strips into an integrally connected and unitary serpentine grid providing a current path extending from one main body to an adjacent main body through the entire width of the first pairs and the second pairs, each first end portion and each second end portion located in the first pairs and the second pairs include a first projection extending across only a portion of the width, each projection mating with another projection cooperatively forming legs extending from the first pairs and second pairs into each of the holes mounting the grid to the mounting members, the legs extend only partially across the width to minimize heat transfer by conduction through the legs into the members, the legs have sufficient length to position the first pairs and second pairs away from the members locating the current path away from the members and minimizing heat transfer by conduction and radiation to the members allowing air flow around the first pairs and second pairs as well as the body to remove heat therefrom, the strips each have thickness with the strips including turbulence producing ribs formed thereon extending lengthwise thereon and an outward distance, the ribs strengthening the members and including an outwardly located portion creating air turbulence increasing heat transfer between the strips and surrounding air.

It is an object of the present invention to provide a new and improved heat dissipating device for use with electric motors.

Another object of the present invention is to provide improved structure for securing heat dissipating grids between insulators.

A further object of the present invention is to provide a new and improved resistor grid assembly having mounting legs to minimize heat dissipation to the adjacent insulators.

In addition, it is an object of the present invention to provide a resistor grid assembly having different sizes of grids within an overall assembly.

Further, it is an object of the present invention to provide a resistor grid assembly having significantly lower temperature insulating brackets.

In conjunction with the above objects, it is an object of the present invention to provide a resistor grid assembly for dissipating heat from an electric motor wherein the assembly includes glass insulators for the mounting of the current carrying grids.

Likewise, it is an object of the present invention to provide a resistor grid assembly having means for increasing turbulence over the grid segments and thereby increasing heat transfer between the segments and surrounding air.

Related objects and advantages of the present invention will be apparent from the following description.

DESCRIPTION OF THE PREFERRED EMBODIMENTS

Figure 1:
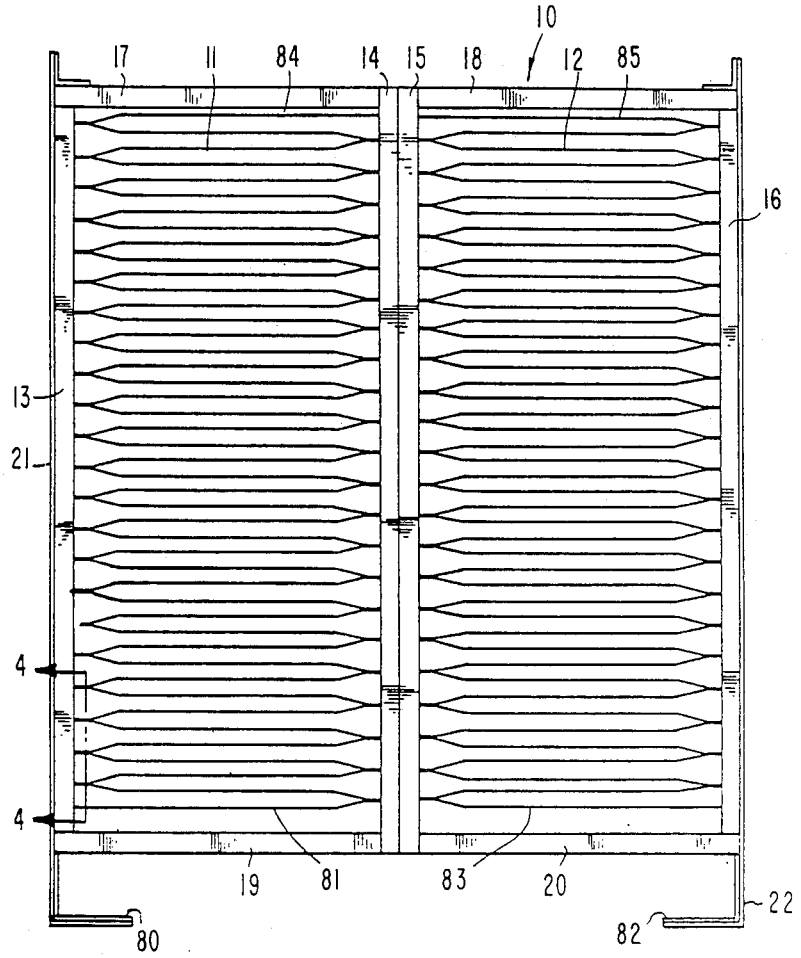
FIG. 1 is a side view of the resistor grid assembly.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown my new and improved resistor grid assembly 10. In the preferred embodiment shown in FIG. 1, assembly 10 includes two resistor grid banks 11 and 12 connected together to form a continuous serpentine current path in order to dissipate heat as the excess current is applied by an electric motor to the grid assembly. Assembly 10 includes four upright insulating members 13, 14, 15 and 16 connected to four end insulating strips 17, 18, 19 and 20. In the particular embodiment shown in FIG. 1, strips 13 through 16 are parallel and are perpendicularly arranged with respect to the four parallel end strips 17 through 20. The resistor grid assembly disclosed herein is particularly advantageous in that the insulating strips may be sized and oriented to receive a particularly shaped grid thereby enabling the overall assembly to fit into any type of desired reception area. Further, the size of the overall assembly may be varied depending upon the amount of heat to be dissipated.

The insulating strips of the assembly shown in the drawings are produced from glass which are able to withstand considerably lower temperatures, in the neighborhood of 130° C., as compared to the prior asbestos insulating strips which would withstand temperatures in the magnitude of 200° C. With the prohibition of asbestos and the substitution therefor of glass, particular care has been taken in designing the mounting of the legs of the grid plates to the insulating strips in order to protect the insulating strips from heat destruction. Such a mounting arrangement allows increased current carrying capacity of the grid plates from approximately 600 amps to 1,000 amps.

The insulating strips may be secured together by conventional fastening means with a pair of mounting bars 21 and 22 affixedly mounted exteriorly to the outer insulating strips 13 and 16.

A grid bank 11 will now be described, it being understood that a similar description applies to grid bank 12. Grid bank 11 is composed of a plurality of grid plates or members arranged in parallel fashion with the adjacent ends of the plates welded together forming a continuous serpentine current path. The resistor plates or members are arranged in pairs with one such pair being shown in FIG. 2. Resistor plates 25 and 26 are produced entirely from sheet metal having parallel main bodies with converging end portions 27 and 28 secured together by seam weld 29. The opposite end portions 30 and 31 diverge outwardly and are not secured together and instead are secured to the respective plates of adjacent pairs. Thus, resistor plate 25 and 26 have a relatively thin sheet metal main body 32 and 33 each with a longitudinally upraised strengthening rib 34 and 35. End portions 27 and 28 of the two main bodies converge together until the main bodies contact along parallel flat ends 36 and 37 with seam weld 29 extending across the width thereof. Integrally formed on end 36 are two radius or semi-circular outwardly extending legs 38 and 39 which are aligned and in contact with a pair of radiused or semi-circular legs 40 and 41 integrally attached to end 37. Thus, legs 38 and 40, along with legs 39 and 41 form a pair of cylindrically hollow mounting legs. The legs are located in the outer one third portions of width of each grid member.

Figure 2:
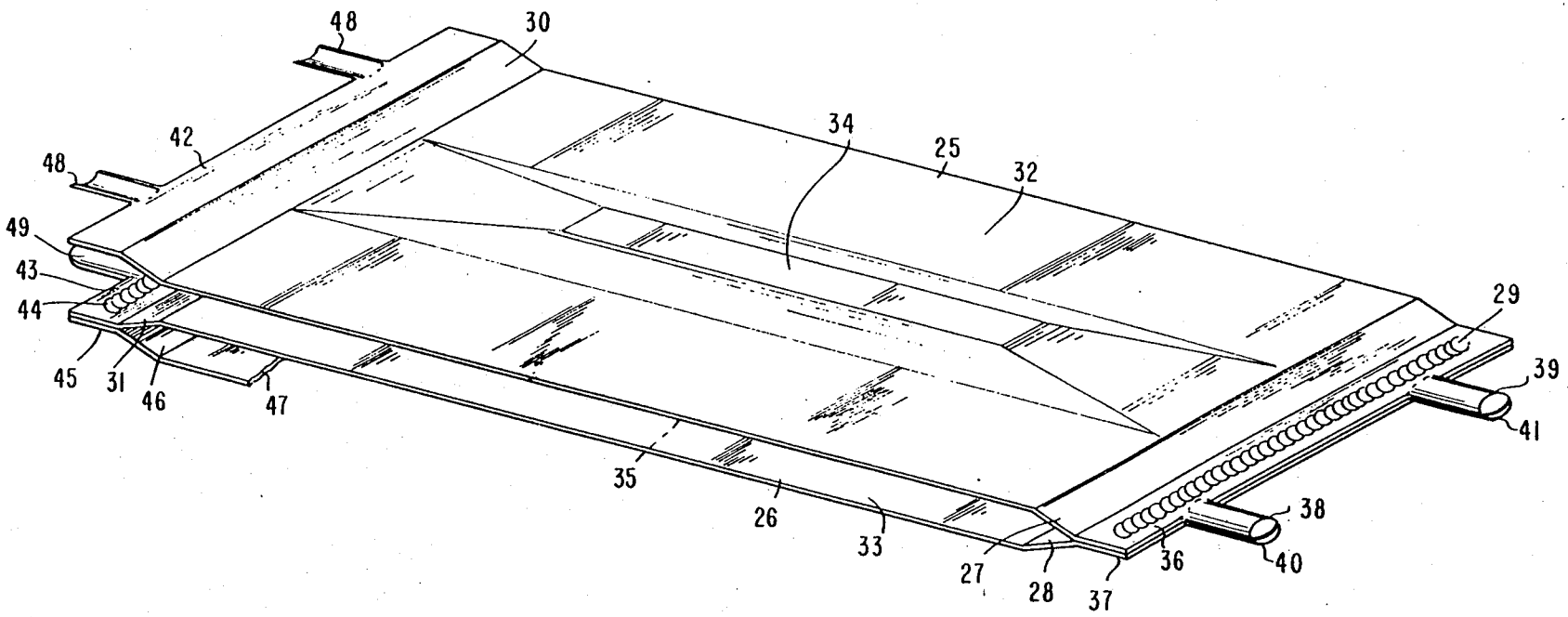
FIG. 2 is an enlarged prospective view of two adjacent grid plates.
Figure 3:
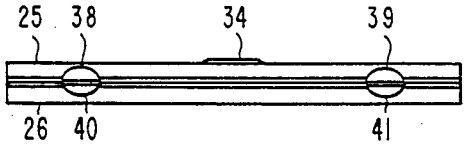
FIG. 3 is an end view of the grid plates of FIG. 2.

The opposite end portions 30 and 31 of main bodies 32 and 33 extend divergingly outward to parallel spaced apart flat ends 42 and 43 which are integrally joined by diverging portions 30 and 31 to the main bodies 32 and 33. Flat portions 42 and 43 are seam welded to flat end portions of adjacent grid members. For example, flat end portion 43 is integrally connected by seam weld 44 to flat end portion 45, in turn integrally connected to portion 46 diverging from portion 31 and integrally connected to the main body 47 of an adjacent grid member. Similarly, flat end portion 42 is integrally attached by a seam weld to the flat end portion of the adjacent grid member positioned above grid member 25. In such a manner, a serpentine path is provided, such as shown in FIG. 1, which winds from the bottom or one end of the resistor grid assembly to the opposite or top end of the assembly. Flat end portions 42 and 43 have outwardly extending pairs of legs 48 and 49 which are identical in configuration to legs 38 and 39 being aligned with adjacent legs of the adjacent grid members to form cylindrical outwardly extending legs. Legs 48 are concave as viewed from atop portion 42 whereas legs 49 are convex as viewed from atop end portion 43. All grid members are identical and are simply reversed 180° in order to provide the serpentine path. For example, grid member 25 is identical to grid member 26 except that grid member 25 is oriented 180° with respect to grid member 26. In all cases, the strengthening ribs 34 and 35 are convex as viewed from atop the grid members such as shown in FIG. 2.

Figure 4:
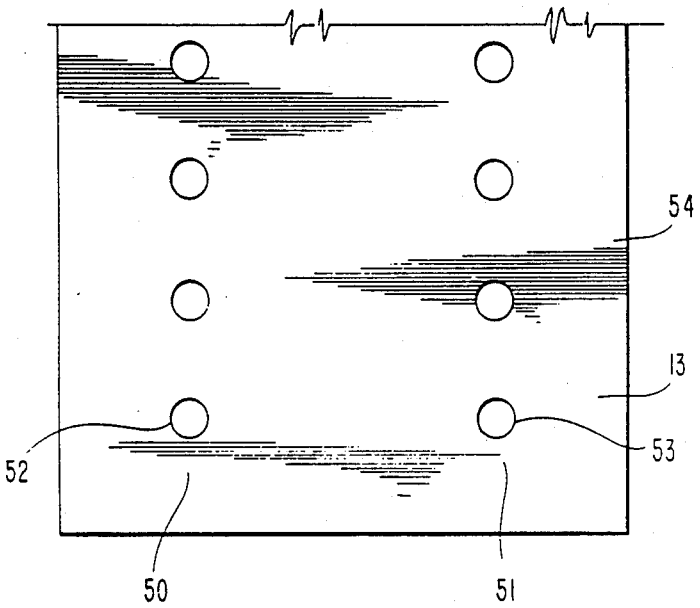
FIG. 4 is a fragmentary enlarged side view taken along line 4—4, FIG. 1 and viewed in the direction of the arrows.
Figure 5:
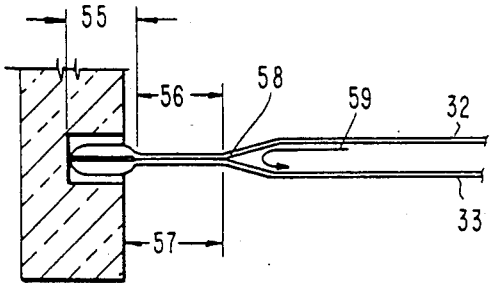
FIG. 5 is an enlarged fragmentary end view of two adjacent grid plates illustrating current flow and spacing from the mounting insulator.

A pair of insulator members are provided at the opposite ends of the grid members, each having a plurality of leg receiving holes located on the mutually facing sides thereof with the holes lined in parallel relationship to each other to receive the outwardly extending legs of the grid members. One such insulator member 13 is partially shown in FIG. 4 and will now be described it being understood that a similar description applies to insulator members 14, 15 and 16. The insulator member 13 is produced from a material to withstand at least 130° C. temperature. In one such embodiment, the insulator was produced from polyester glass. Two rows 50 and 51 of generally round holes 52 and 53 are provided on the inwardly facing surface 54 of the insulator member, with holes 52 aligned with holes 53 in order to receive the outwardly extending legs of the grid members. Holes 52 and 53 extend only partially through the insulator member, but have sufficient length to mountingly receive the legs. The depth of each hole may be dimensioned to be less than the length of the corresponding receiving leg so that the leg will bottom out in the hole thereby spacing apart the edge of the flat end portion from the insulator inwardly facing surface. In other words, a gap may be provided between surface 54 and the edge of flat end portions 36 and 37 limiting the contact between the grid members and the insulator members except at the location of the legs. In one particular embodiment, each leg had a length 55 (FIG. 5) of ½ inch whereas the flat end portions 36 and 37 had a length 56 from the legs to the converging end portions 27 and 28 of approximately ⅜ inches. Thus, if each hole 52 and 53 has a depth of for example ⅜ inches, then the legs will bottom out and the edge of each flat portion will be spaced apart from the insulator at least ⅛ inch and the location of divergence 58 of main bodies 32 and 33 will be a distance 57 of at least ½ inch maximizing the distance between the main bodies of the grid members and the insulator members. The current flow path 59 extends through main body 32 to the point of divergence 58 and then through the main body 33 of the adjacent grid member and is directed away from the legs and the insulator member. As a result, the distance 57 of the current flow path from the insulator is maximized decreasing the amount of heat transfer either by convection or radiation from the grid members to the insulator members. Forced air means are provided to direct pressurized air through the grid members thereby transferring the heat from the grid members and away from the grid assembly.

The grid assembly disclosed herein is particularly advantageous over the prior grid assemblies in that grid members and insulators of different lengths may be mixed together to obtain an optimum configured and sized grid assembly. For example, a grid assembly 60 (FIG. 6) includes a plurality of grid members identical to those previously described which are assembled into a single serpentine path with the lower grid member 61 through 65 having equal lengths and longer than the top seven grid members 66 through 72. An intermediate length grid member 73 integrally connects together grid members 65 and 66. Thus, the two upper insulator members 74 and 75 are spaced apart a distance less than the spacing of the two lower insulator members 76 and 77. In such a manner, the overall grid assembly may be designed to fit into a particular space or to handle a specific heat carrying capacity.

Figure 6:
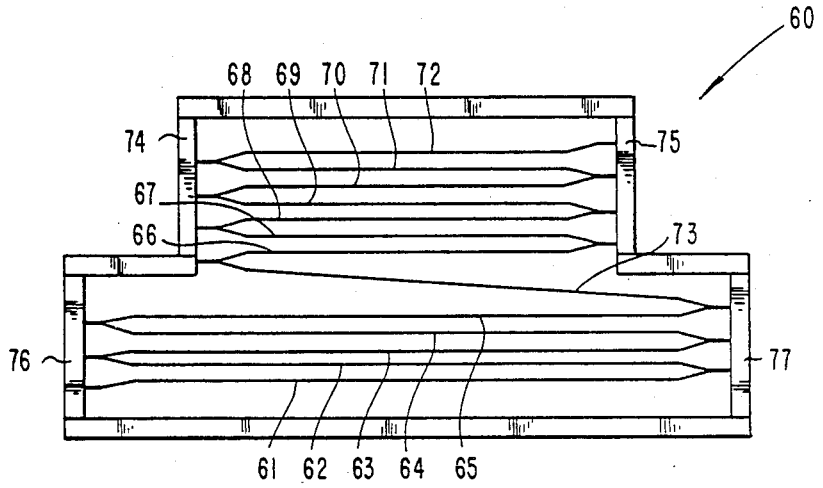
FIG. 6 is a side view of an alternate embodiment of the resistor grid assembly having different lengths of grid plates.

In all cases such as the design shown in FIGS. 1 or 6, the grid assembly must include input and output terminal means and additional means for interconnecting separate banks together. For example, bank 11 includes an input terminal 80 electrically connected to the lower grid member 81 and with an output terminal 82 being electrically connected to the lower grid member 83 of bank 12. Banks 11 and 12 are electrically connected by the uppermost grid member 84 of bank 11 to the uppermost grid member 85 of bank 12. The banks may be electrically connected together by extending connection means such as a plate from one end of grid member 84 to an opposite end of grid member 85. Thus, a continuous serpentine path is provided from terminal 80 through bank 11 and then through bank 12 to output terminal means 82. Terminal means 80 and 82 extend respectively either through end insulator members 19 and 20 or side insulator members 13 and 16 in order to be electrically connected to the lower most grid members 81 and 83. The input and output terminals are not shown in FIG. 6.

Figures 7, 8:
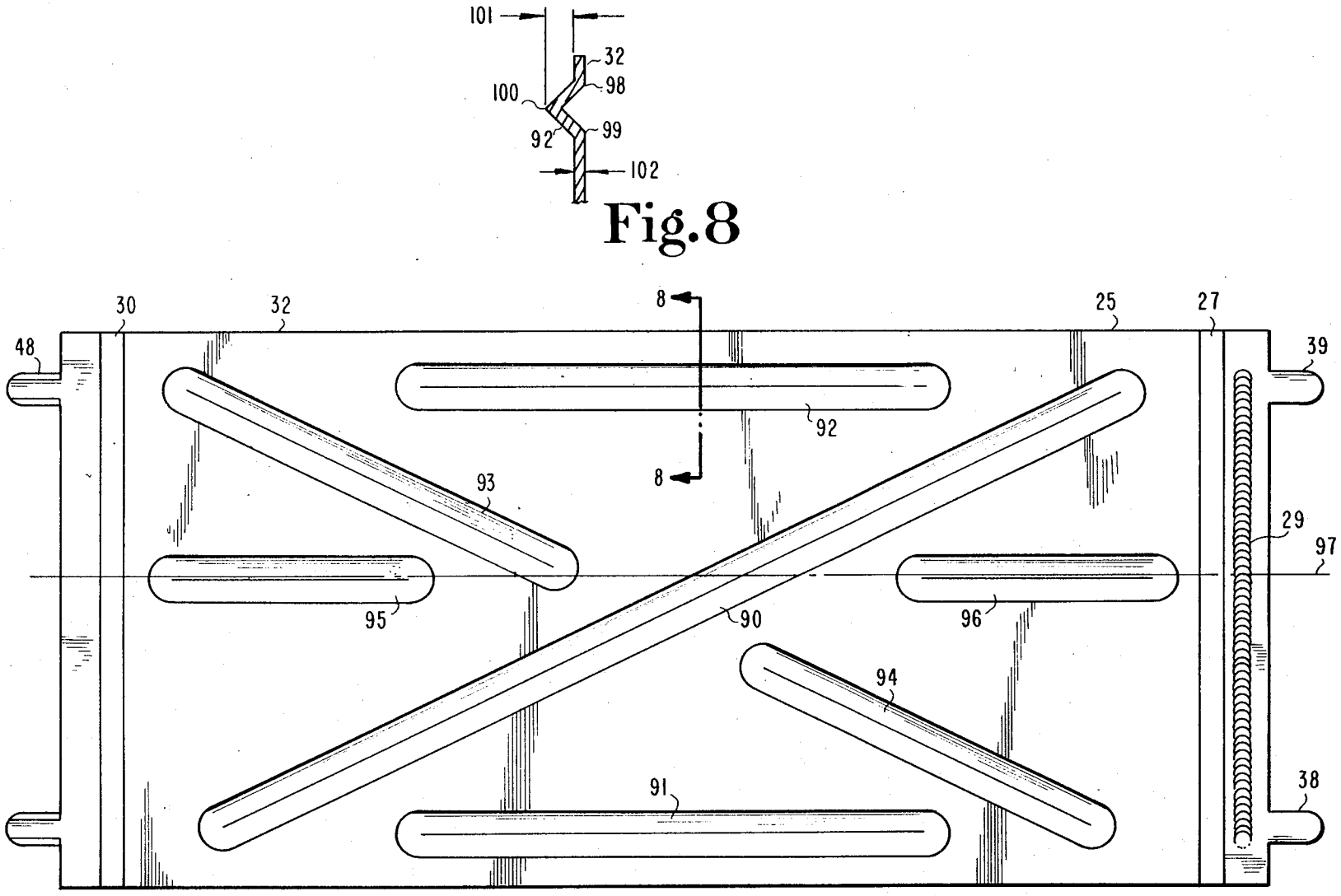
FIG. 7 is a top view of the preferred embodiment of the grid plate 25 shown in FIG. 2.
FIG. 8 is a cross sectional view taken along the line 8—8 of FIG. 7 and viewed in the direction of the arrows.

The preferred embodiment of the strengthening ribs provided on the resistor plate is shown in the top view of plate 25 of FIG. 7. The resistor plate 25 shown in FIG. 7 is identical to plate 25 previously described and shown in FIG. 2 except for the strengthening ribs and is connected to the remaining components of the assembly in identical manner. Plate 25(FIG. 8) has a main body 32 with offset ends 27 and 30 with legs 39, 38 and 48 integrally mounted thereto. Weld 29 secures plate 25 to the offset end of the plate positioned therebeneath. A diagonally extending rib 90 extends lengthwise on the main body 32 of the plate separating apart a pair of diagonally extending ribs 93 and 94 which also extend lengthwise on the plate. Ribs 93 and 94 are aligned together extending in the same direction. A second pair of ribs 91 and 92 are positioned adjacent the opposite lengthwise edges of the plate main body with a third pair of ribs 95 and 96 provided along the longitudinal axis 97 of the plate main body and extending inwardly from offset portions 30 and 27.

Ribs 90 through 96 are identical in cross section and thus, the following description of rib 92 applies equally to the remaining ribs 90 and 93 through 96. Rib 92 is convex as viewed in FIG. 7 and is characterized in that the rib is formed by three sharp edges. Rib 92 (FIG. 8) extends sharply away from main body 32 forming edges 98 and 99 to a outwardly located edge 100. The height 101 of rib 92 in a direction perpendicular to main body 32 is at least twice the thickness 102 of main body 32 and in one embodiment was approximately two and one-half times the thickness. As a result of an outward portion of the rib including the sharp edge 100 as well as the distance 101, the ribs create air turbulence adjacent the resistor plate as air forced thereacross thereby increasing heat transfer between the grid plates and the surrounding air. Further, by arranging the grids to extend in the directions shown in FIG. 7 the air turbulence is increased and the structural rigidity of the plate is increased thereby resisting plate twisting under load. In one embodiment, the plate has a thickness of 0.062 inches whereas dimensions 101 is approximately 1.124 inches. In the same embodiment, all of the ribs on all of the resistor plates were convex in the same direction. That is, as viewed in FIG. 7, all ribs were convex or bowed upwardly.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A resistor grid comprising:

a plurality of first planar grid members of resistance material, each of said grid members having first and second offset planar ends, said ends of adjacent grid members being welded together to form a tight first serpentine path for the flow of electric current, said grid members lying in substantially parallel relationship to each other, said grid members positioned outermost in said serpentine path having first terminal means connected thereto to provide electrical current input and discharge paths for the resistor grid, said ends of said grid members welded together across their widths and each having a first leg extending only partially across said widths and projecting outwardly therefrom in a direction generally parallel to the longitudinal axis of said grid members with said grid members including said leg each being of a one piece sheet metal construction; and, first and second insulator members each having a plurality of leg-receiving holes located on one side thereof with said holes lying in parallel relation to each other and extending only partially through said first and second insulator members, said insulating members being spaced apart and in parallel relation to each other with said one side of said members being inwardly opposed to one another, said leg of said members being positioned in said leg-receiving holes of said first and second insulator members; and wherein:

said grid members each have thickness with said grid members including turbulence producing ribs formed therein extending lengthwise thereon and in an outward direction, said ribs strengthening said members and including an outwardly located portion creating air turbulence increasing heat transfer between said grid members and surrounding air.

2. The resistor grid of claim 1 wherein:

said ribs extend a distance perpendicular to said grid members at least twice said thickness.

3. The resistor grid of claim 2 wherein:

said ribs extend lengthwise at different angles to said longitudinal axis, said ribs further extend outwardly in the same direction.

4. The resistor grid of claim 3 and further comprising:

a second leg projecting outwardly from each of said ends in a direction generally parallel to the longitudinal axis of said grid members; and wherein:

said grid members welded together are seam welded across the entire width of said grid members, said grid members are identical but are alternately orientated 180 degrees relative to adjacent grid members, each end of each grid member includes first and second leg components projecting outwardly therefrom in a direction generally parallel to the longitudinal axis of said member, said first and second leg projecting from said ends are formed by the aligned positioning of first and second leg components before adjacent grid members are welded together.

5. The resistor grid of claim 4 wherein:

said first and second leg components projecting from said ends are integrally associated with said grid members with the material of said leg components being the continuation of the resistance material comprising said grid members.

6. The resistor grid of claim 5 wherein:

said first and second leg components on said ends have a radial shape forming said first and second leg in a generally cylindrical shape when said leg components of adjacent grid members are aligned and adjacent grid members are welded together.

7. The resistor grid of claim 6 wherein:

said first and second leg components on said ends are of sheet metal composition.

8. The resistor grid of claim 1 wherein:

said grid members are arranged in pairs with said planar ends converging together at one end and with said planar ends diverging apart at the end opposite of said one end and connected to grid members of adjacent pairs of grid members, said grid members including main bodies spaced apart but contacting together when said planar ends converge together at a first location extending widthwise across said main bodies providing a current path from one grid member through said first location to an adjacent member and directing said current path away from said leg and said insulator members, said holes have depths shorter than the lengths of said leg insuring said leg bottoms out in said holes and space said planar ends apart from said insulator members except at said leg limiting contact between said grid members and said insulator members, maximizing the distance from an insulator member to said said first location of contact between said main bodies and minimizing heat transfer via conduction and convection from said grid members to said insulator members.

9. The resistor grid of claim 8 and further comprising:

a plurality of second planar grid members of resistance material identical to said first planar grid members except for size, each of said second grid members having third and fourth offset planar ends, said third and fourth offset planar ends of adjacent second grid members being welded to form a tight second serpentine path for the flow of electric current, said second grid members lying in substantially parallel relationship to each other, said second grid members positioned outermost in said second serpentine path having second terminal means mounted thereto and connected electrically with said first terminal means providing a continuous path through said first and second serpentine path to provide electrical current input and discharge paths for the resistor grid, said third and fourth ends of said second grid members welded together each having a third leg projecting outwardly therefrom in a direction generally parallel to the longitudinal axis of said second grid members; and third and fourth insulator members parallel to said first and second insulator members and each having a plurality of second leg-receiving holes located on a second side thereof with said second holes lying in parallel relation to each other and extending only partially through said third and fourth insulator members, said insulating members being spaced apart and in parallel relation to each other with said second side of said third and fourth insulator members being inwardly opposed to one another, said third leg being positioned in said second leg-receiving holes of said third and fourth insulator members.

10. A resistor grid assembly comprising:

a pair of parallel mounting members of electrical non-conductive material having mutually opposed faces each with rows of generally round spaced apart holes formed therein;

a plurality of individual electrically-conductive heat transfer strips with mutually opposed faces, each strip having a sheet metal main body with a first end portion and a second end portion offset equal distances but on opposite sides therefrom and being integrally connected to said main body, said strips are arranged in alternating fashion to position each first end portion into first pairs and each second end portion into second pairs offset from said first pairs, said first pairs and said second pairs each have width equal to said main body with said first pairs welded together and said second pairs welded together across said width arranging said strips into an integrally connected and unitary serpentine grid providing a current path extending from one main body to an adjacent main body through the entire width of said first pairs and said second pairs, each first end portion and each second end portion located in said first pairs and said second pairs include a first projection extending across only a portion of said width, each projection mating with another projection cooperatively forming legs extending from said first pairs and second pairs into each of said holes mounting said grid to said mounting members, said legs extend only partially across said width to minimize heat transfer by conduction through said legs into said members, said legs have sufficient length to position said first pairs and second pairs away from said members locating said current path away from said members and minimizing heat transfer by conduction and radiation to said members allowing air flow around said first pairs and second pairs as well as said body to remove heat therefrom; and wherein:

said strips each have thickness with said strips including turbulence producing ribs formed thereon extending lengthwise thereon and in an outward direction, said ribs strengthening said members and including an outwardly located portion creating air turbulence increasing heat transfer between said strips and surrounding air.

11. The resistor grid assembly of claim 10 and further comprising:

said ribs extend a distance perpendicular to said strips at least twice said thickness.

12. The resistor grid assembly of claim 11 wherein:

each of said strips include a longitudinal axis and a plurality of said ribs extending lengthwise thereon at different angles to said longitudinal axis with said ribs extending from said strips in the same direction.

13. The resistor grid assembly of claim 12 and further comprising:

second projections extending across only a portion of said width, each second projection mating with another second projection cooperatively forming second legs extending from said first pairs and second pairs into each of said holes mounting said grid to said mounting members; and wherein:

said first and first legs being spaced apart and positioned within opposite outside one third portions of said first pairs welded together and second pairs welded together, said first and second projections extending from each said first end portion and second end portion located in said first pairs and said second pairs are integrally associated with said electrically-conductive heat transfer strips, the material of said first and second projections being the continuation of the material comprising said electrically-conductive heat transfer strips.

14. The resistor grid assembly of claim 13 wherein, said first and second projections extending from each said first end portion and second end portion located in said first pairs and said second pairs have a radial shape cooperatively forming said first and second legs in a generally cylindrical shape.

15. The resistor grid assembly of claim 14 wherein:

said first and second projections extend from each said first end portion and second end portion located in said first pairs and said second pairs being of sheet metal composition.

16. A resistor grid comprising:

a plurality of first planar grid members of resistance material, each of said grid members having first and second offset planar ends, said ends of adjacent grid members being welded together to form a tight first serpentine path for the flow of electric current, some of said grid members positioned to said serpentine path having first terminal means connected thereto to provide electrical current input and discharge paths for the resistor grid, said ends of said grid members welded together across their widths and each having a first leg extending only partially across said widths and projecting outwardly therefrom in a direction generally parallel to the longitudinal axis of said grid members with said grid members including said leg each being of a one piece sheet metal construction; and first and second insulator members each having a plurality of leg-receiving holes located on one side thereof, said insulating members being spaced apart with said one side of said members being inwardly opposed to one another, said leg of said members being positioned in said leg-receiving holes of said first and second insulator members; and wherein:

said grid members each have thickness with said grid members including turbulence producing ribs formed thereon extending lengthwise thereon and in an outward direction, said ribs strengthening said members and including an outwardly located portion creating air turbulence increasing heat transfer between said grid members and surrounding air.

17. The resistor grid of claim 16 wherein:

said ribs extend a distance perpendicular to said grid members at least twice said thickness.

18. The resistor grid of claim 17 wherein:

each of said grid members include a longitudinal axis and a plurality of said ribs extending lengthwise thereon at different angles to said longitudinal axis with said ribs extending outwardly from said grid members in the same direction.

19. A resistor grid assembly comprising:

a pair of mounting members of electrical non-conductive material having mutually opposed faces each with rows of generally round spaced apart holes formed therein;

a plurality of individual electrically-conductive heat transfer strips with mutually opposed faces, each strip having a sheet metal main body with a first end portion and a second end portion offset equal distances but on opposite sides therefrom and being integrally connected to said main body, said strips are arranged in alternating fashion to position each first end portion into first pairs and each second end portion into second pairs offset from said first pairs, said first pairs and said second pairs each have width equal to said main body with said first pairs welded together and said second pairs welded together across said width arranging said strips into an integrally connected and unitary serpentine grid providing a current path extending from one main body to an adjacent main body through the entire width of said first pairs and said second pairs, each first end portion and each second end portion located in said first pairs and said second pairs include a first projection extending across only a portion of said width, each projection mating with another projection cooperatively forming legs extending from said first pairs and second pairs into each of said holes mounting said grid to said mounting members, said legs extend only partially across said width to minimize heat transfer by conduction through said legs into said members, said legs have sufficient length to position said first pairs and second pairs away from said members locating said current path away from said members and minimizing heat transfer by conduction and radiation to said members allowing air flow around said first pairs and second pairs as well as said body to remove heat therefrom; and wherein:

said strips each have thickness with said strips including turbulence producing ribs formed thereon extending lengthwise thereon and in an outward direction, said ribs strengthening said members and including an outwardly located portion creating air turbulence increasing heat transfer between said strips and surrounding air.

20. The resistor grid assembly of claim 19 and further comprising:

said ribs extend a distance perpendicular to said strips at least twice said thickness; and wherein:

each of said strips include a longitudinal axis and a plurality of said ribs extending lengthwise thereon at different angles to said longitudinal axis and also outwardly in the same direction.

* * * * *